US005671670A

United States Patent [19]

Takahashi et al.

[11] Patent Number: 5,671,670

[45] Date of Patent: Sep. 30, 1997

[54] STENCIL PRINTER HAVING A CONSTRUCTION FOR PREVENTING INK LEAKAGE

[75] Inventors: Yasuhiro Takahashi; Nagon Takita, both of Tokyo, Japan

[73] Assignee: Riso Kagaku Corporation, Tokyo, Japan

[21] Appl. No.: 574,575

[22] Filed: Dec. 14, 1995

Related U.S. Application Data

[63] Continuation of Ser. No. 332,033, Oct. 1, 1994, abandoned.

[30] Foreign Application Priority Data

Nov. 12, 1993 [JP] Japan ..... 5-306038
Mar. 10, 1994 [JP] Japan ..... 6-066708

[51] Int. Cl.[6] ..... B41L 13/04

[52] U.S. Cl. ..... 101/116; 101/120

[58] Field of Search ..... 101/114, 120, 101/127, 127.1, 128, 128.1, 129, 174, 211, 116

[56] References Cited

U.S. PATENT DOCUMENTS 3,915,087 10/1975 Tiemann ..... 101/116
4,905,595 3/1990 Jeschke ..... 101/174
4,911,069 3/1990 Hayama et al. .
5,081,924 1/1992 Ohinata ..... 101/116
5,373,785 12/1994 Yamamoto et al. ..... 101/116

FOREIGN PATENT DOCUMENTS 0555073 8/1993 European Pat. Off. .
1204781 8/1989 Japan .
2225078 9/1990 Japan .
4105984 4/1992 Japan .
2241672 9/1991 United Kingdom .

*Primary Examiner*—Edgar R. Burr
*Assistant Examiner*—Anthony H. Nguyen
*Attorney, Agent, or Firm*—Watson Cole Stevens Davis, P.L.L.C.

[57] ABSTRACT

A stencil printer having a printing drum which is inked from the inside thereof. In order to prevent leaking out of ink from the perforated portion over the non-perforated stencil sheet leading end mounting portion of the stencil printing drum, in a construction wherein a printing drum cooperates with a back press roller or a transfer roller with a transverse bar portion of the printing drum is received in a transfer groove of the back press roller or the transfer roller, the outer circumferential length of the perforated portion of the printing drum and the traverse groove of the back press roller or the transfer roller and the relative rotation phase therebetween are so determined that the perforated portion is not laid one over the other with the transfer groove.

10 Claims, 7 Drawing Sheets

STENCIL PRINTER HAVING A CONSTRUCTION FOR PREVENTING INK LEAKAGE

This application is a continuation of application Ser. No. 08/332,033, filed Nov. 1, 1994, now abandoned.

BACKGROUND OF THE INVENTION

1. Field of the Invention

The present invention relates to a stencil printer, and more particularly to a construction for preventing ink leakage from the printing drum of the stencil printer.

2. Description of the Prior Art

A stencil printer comprising a printing drum having a perforated construction at a circumferential portion thereof excluding two annular edge portions extending along opposite axial ends of a cylindrical configuration thereof and a strip-like stencil sheet leading end mounting portion extending between said two annular edge portions along a generatrix of said cylindrical configuration, and a back press roller having a transverse groove at an outer circumferential portion extending along a generatrix thereof, said printing drum and said back press roller being arranged to be close to and in parallel with one another so as to be rotated in mutually opposite rotational directions in synchronization with said stencil sheet leading end mounting portion aligning with said transverse groove such that a stencil sheet wrapped around said printing drum applies a stencil printing to a print sheet fed between said printing drum and said back press roller with ink supplied through said perforated portion of said printing drum is shown in Japanese Patent Application 63-28553(Laid-open Publication 1-204781), Japanese Patent Application 1-47029(Laid-open Publication 2-225078), Japanese Patent Application 2-223550(Laid-open Publication 4-105984) and others.

SUMMARY OF THE INVENTION

It is an object of the present invention to improve the stencil printer of the above-mentioned basic construction for carrying out a stencil printing by a stencil sheet wrapped around the printing drum with the ink supplied through the perforated portion of the printing drum so as to definitely prevent ink leakage from the printing drum.

According to the present invention, the above-mentioned object is accomplished by constructing the stencil printer having the above-mentioned basic construction such that the circumferential length of each of said perforated portion of said printing drum and said transverse groove of said back press roller and the relative rotation phase between said perforated portion and said transverse groove are so determined that said perforated portion is not laid one over the other with said transverse groove. Further, in the case of a stencil printer wherein a transfer roller is interposed between the printing drum and the back press roller so that a printing image is applied onto the transfer roller by a stencil sheet wrapped around the printing drum with ink supplied through the perforated portion of the printing drum, and the ink image provided on the transfer roller is transferred onto a print sheet fed between the transfer roller and the back press roller, wherein the perforated portion of the printing drum is an outer circumferential portion thereof excluding two annular portions extending along opposite axial ends of a cylindrical configuration thereof and a strip-like stencil sheet leading end mounting portion extending between the two annular edge portions along a generation of the cylindrical configuration, the printing drum and the transfer roller being adapted to rotate in mutually opposite rotational direction in synchronization with one another with the stencil sheet leading end mounting portion of the printing drum aligning with the transverse groove of the transfer roller, the above-mentioned object of the present invention is accomplished by constructing the stencil printer such that the circumferential length of each of said perforated portion of the printing drum and said transverse groove of the transfer roller and the relative rotation phase between said perforated portion and said transverse groove are so determined that said perforated portion is not exposed to with said transverse groove in spite of said relative rotational shifting between said printing drum and said back press roller for adjusted the position of the stencil print relative to the print sheet.

In order to obtain a stencil printing image having a uniform depth all through from the upper end to the lower end thereof, it is required that the perforated portion of the printing drum is supplied with a sufficient amount of ink to the portions thereof bordering between the perforated portion and the stencil sheet leading end mounting portion having a non-perforated construction. Therefore, when those portions are supplied with a sufficient amount of ink, such a supply of ink to those portions generally becomes excessive, generating an accumulation of an excessive ink around the leading and trailing edge portions of the perforated portion of the printing drum. In view of these, when the circumferential length of each of said perforated portion of the printing drum and said transverse groove of the back press roller or the transfer roller and the relative rotation phase between said perforated portion and said transverse groove are so determined that said perforated portion is not laid one over the other with said transverse groove, the non-perforated portion bordering said perforated portion of the printing drum is definitely applied with a pressing by the back press roller or the transfer roller once every time when the printing drum makes one rotation, so that the ink tending to flow over the outer surface of the non-perforated portion bordering said perforated portion is definitely squeezed back, thereby definitely avoiding an accumulation of ink to generate at these portions.

BRIEF DESCRIPTION OF THE DRAWING

In the accompanying drawing.

DESCRIPTION OF THE PREFERRED EMBODIMENTS

In the following the present invention will be described with respect to embodiments with reference to the accompanying drawing.

Figure 1:
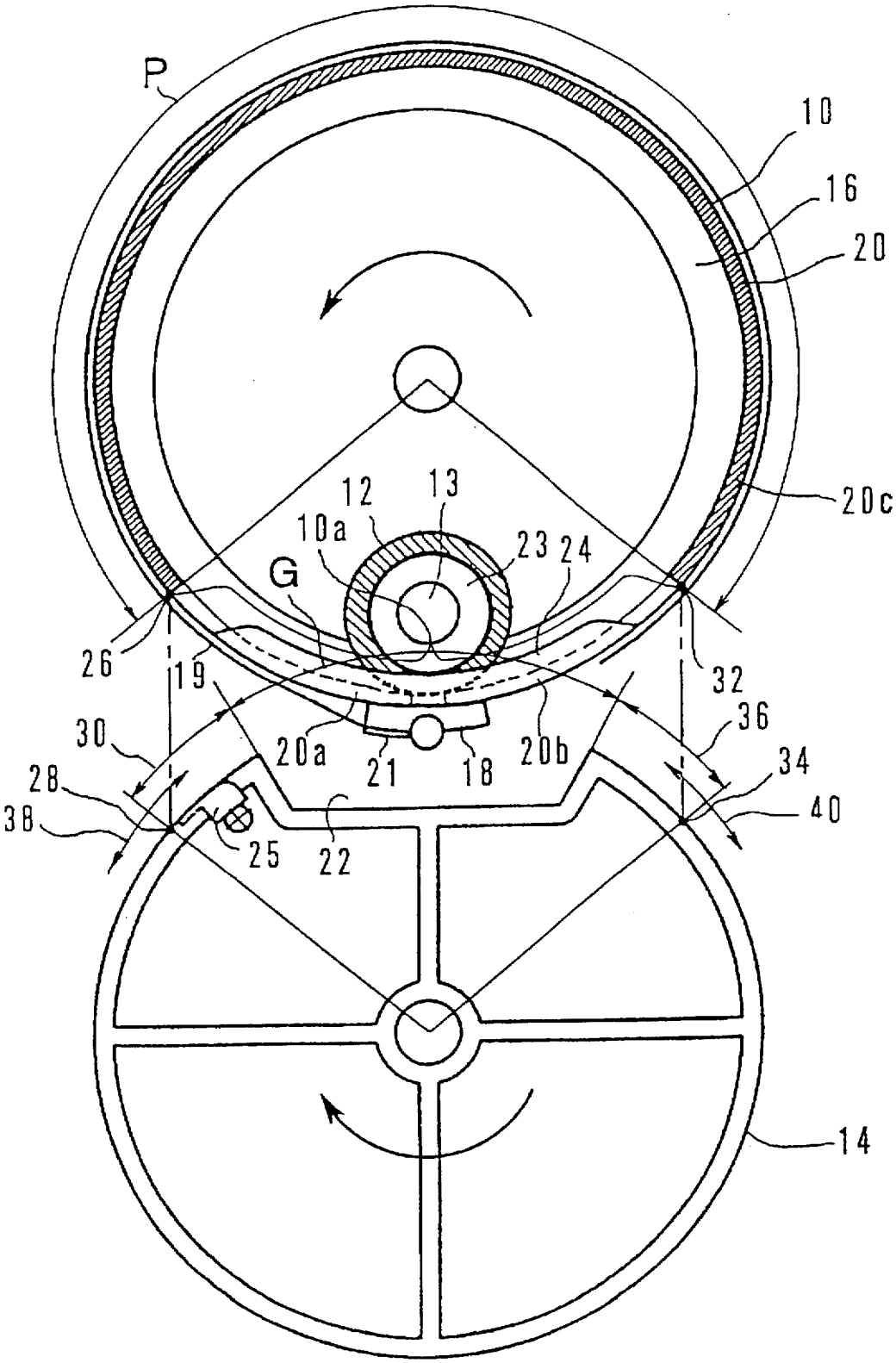
FIG. 1 is a diagrammatical view of an embodiment of a stencil printer having the construction for preventing ink leakage according to the present invention, showing only those portions thereof concerned with the essence of the present invention.

Referring to FIG. 1 diagrammatically showing an embodiment of the stencil printer having the construction for preventing ink leakage according to the present invention about only those portions of the printing drum and the back press roller concerned with the essence of the present invention, 10 is a printing drum and 14 is a back press roller. The printing drum 10 has opposite axial ends constructed by a pair of annular portions 16 which are connected with one another by a transverse bar portion 18 extending in parallel with a central axis of the printing drum, thereby constructing the frame body of the printing drum. A flexible perforated sheet 20 having a rectangular configuration in development is mounted to seat around the outer peripheral surfaces of the pair of annular portion 16 along opposite side edge portions thereof, with a leading end portion 20*a* and a trailing end portion 20*b* of the flexible perforated sheet being respectively mounted to the transverse bar portion 18. Although in the construction shown in FIG. 1 the leading end portion 20*a* and the trailing end portion 20*b* are simply laid over the corresponding portions of the transverse bar portion 18 according to a diagrammatical illustration, a particular construction for the mounting of the trailing end portion 20*b* to the transverse bar portion 18 is shown in the aforementioned Japanese Patent Application 1-47029, Japanese Patent Application 5-306028 and Japanese Patent Application 5-306029. A stencil sheet 19 is wrapped around the cylindrical surface of the printing drum 10 constructed by the flexible perforated sheet 20 with a leading end portion thereof being mounted to the transverse bar portion 18 by a clamp 21.

Since the mounting construction of the leading end portion and the trailing end portion of the flexible perforated sheet to the transverse bar portion is not directly concerned with the essence of the present invention, detailed illustration and description with regard to the mounting construction are omitted. The leading end portion 20*a* and the trailing end portion 20*b* of the flexible perforated sheet 20 are both of a non-perforated construction, while an intermediate portion 20*c* therebetween has a perforated construction which allows ink to pass therethrough. The leading end portion 20*a* and the trailing end portion 20*b* having a non-perforated construction and the transverse bar portion 18 construct in unison a stencil sheet leading end mounting portion 10*a* of a strip-like nonperforated construction extending between the opposite axial ends of the printing drum along a generation of the printing drum 10.

On the other hand, the back press roller 14 is formed with a transverse groove 22 in parallel with the central axis thereof along a generatrix thereof. The printing drum 10 and the back press roller 14 are of a same diameter as one another and are adapted to rotate in mutually opposite directions in synchronization with one another so that the stencil sheet leading end mounting portion 10*a* of the printing drum aligns with the transverse groove 22 of the back press roller when they oppose one another. The printing drum 10 rotates in the anti-clockwise direction, while the back press roller 14 rotates in the clockwise direction, both viewed in FIG. 1

An inking roller 12 is provided inside the printing drum 10 to be rotatable with a shaft 13 thereof along a central axis thereof, with outer circumferential surface thereof being kept in contact with an inner circumferential surface of the printing drum 10. 24 is a cam adapted to cooperate with a cam follower 23 mounted on the shaft 13 of the inking roller 12 so as to bias the inking roller 12 radially inwardly of the printing drum when the transverse bar portion 18 traverses below the inking roller 12 during rotation of the printing drum, whereby it is avoided that the inking roller 12 contacts the transverse bar portion 18. 25 is a clamp for temporarily fastening a leading end of a print sheet onto the back press roller 14.

As will be apparent from FIG. 1, the outer circumferential length of each of the perforated portion 20*c* of the printing drum 10 and the transverse groove 22 of the back press roller 14, P and G (provided that the outer circumferential length is defined to be a length along a cylindrical configuration of the printing drum or the back press roller as a whole), and the relative rotation phase between the perforated portion 20*c* and the transverse groove 22 are so determined that the perforated portion 20*c* is not exposed to the transverse groove 22, so that an outer circumferential portion 30 is left between a point (actually a line) 28 On the outer circumferential surface of the back press roller corresponding to the bordering point (actually a line) 26 between the perforated portion 20*c* and the non-perforated leading end portion 20*a* of the flexible perforated sheet 20 and the transverse groove 22, while an outer circumferential portion 36 is left between a point (actually a line) 34 on the outer circumferential surface of the back press roller corresponding to the bordering point (actually a line) 32 between the perforated portion 20*c* and the trailing end portion 20*b* of the flexible perforated sheet 20 and the transverse groove 22. By the existence of these outer, circumferential portions 30 and 36 on the back press roller 14, when the bordering point 26 or 32 passes through a position where it contacts with the inking roller 12 such that the squeezing action applied thereto by the inking roller 12 would urge ink through the perforated portion onto the non-perforated outer circumferential portion of the stencil sheet leading end mounting portion thereof, the ink is squeezed back by the rigid cylindrical outer circumferential surface of the back press roller 14, thereby definitely preventing the ink from leaking out beyond the bordering point 26 or 32 onto the non-perforated leading end portion 20*a* or trailing end portion 20*b* .

In Japanese Patent Application 5-306033 by the same assignee as that of the present application it is described to shift the relative rotational position between the printing drum 10 and the back press roller 14 in circumferential directions from a standard position such as shown in FIG. 1 where the transverse bar portion 18 and the transverse groove 22 are just aligned with one another, for the purpose of adjusting the longitudinal position of the print image relative to the print sheet.

Figure 2:
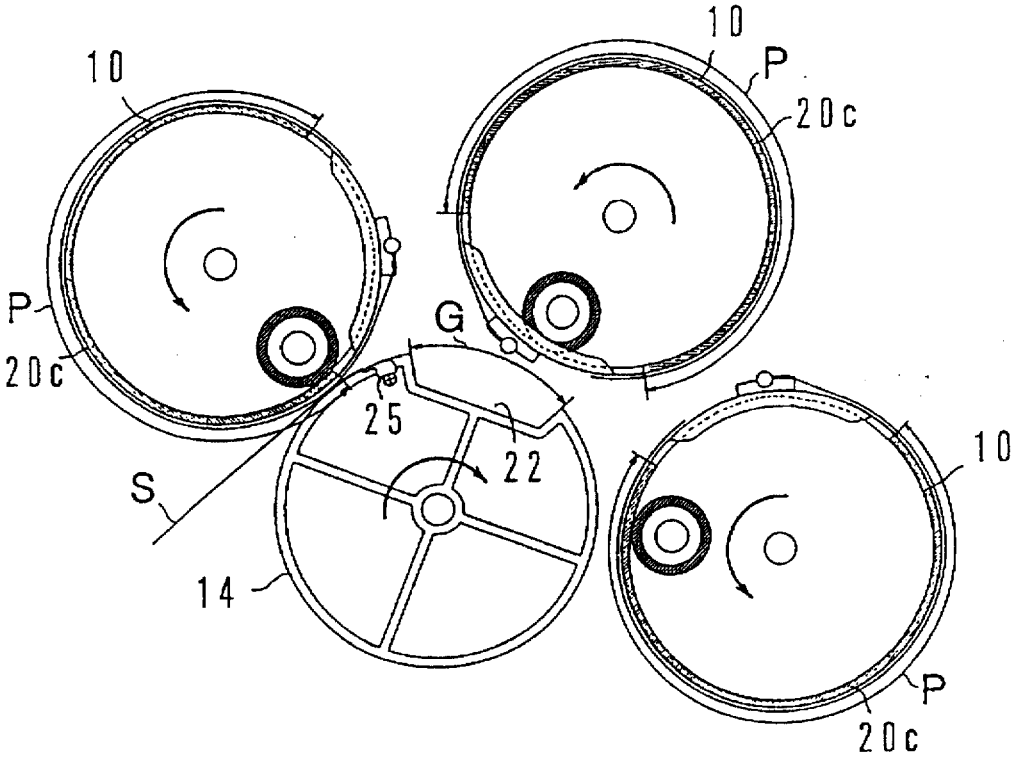
FIG. 2 is a diagrammatical view of an embodiment of a multiple stencil printer in which the present invention is incorporated.
Figure 8:
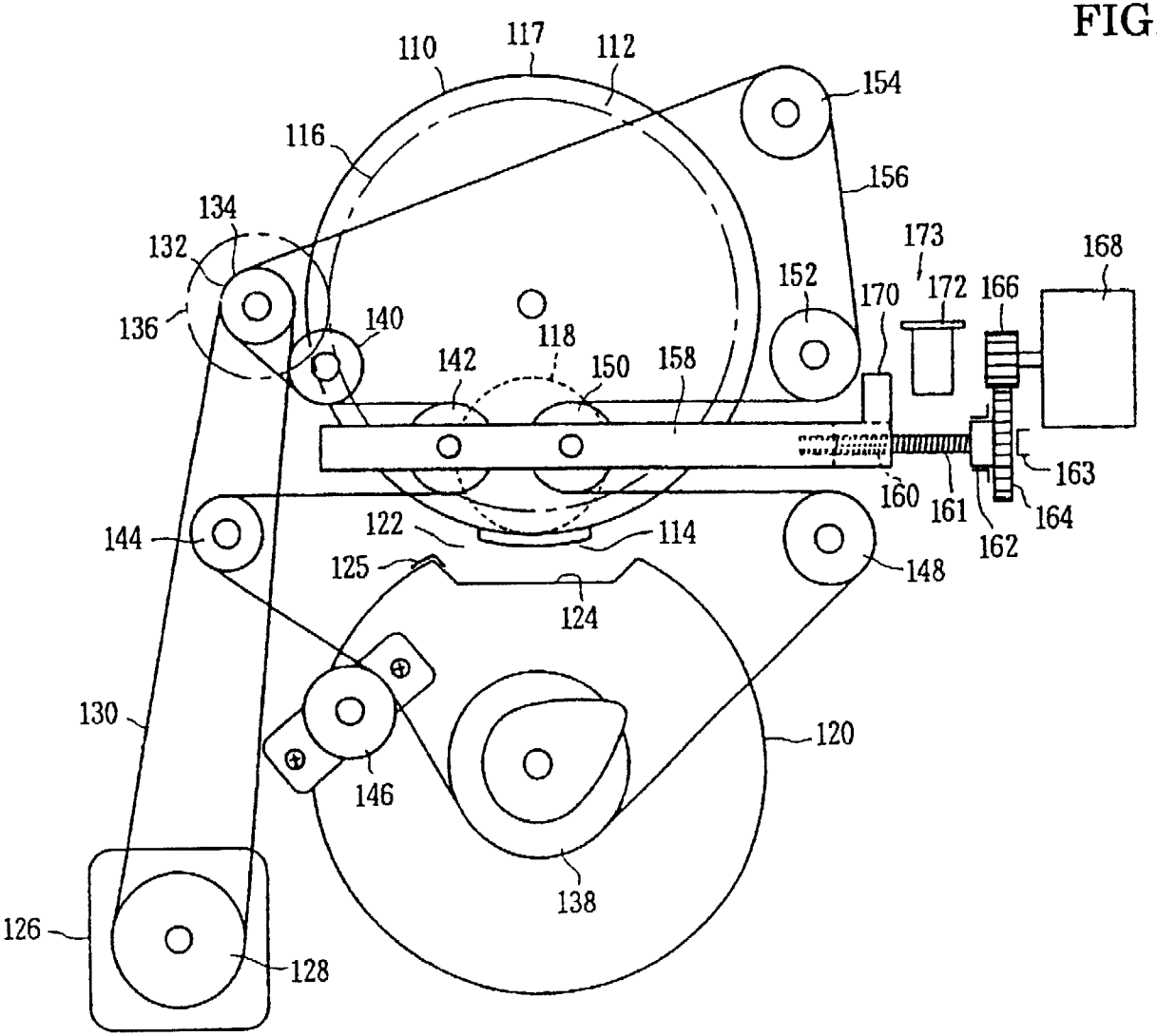
FIG. 8 is a diagrammatical view of a stencil printer incorporating a mechanism for variably adjusting the relative rotational position between the printing drum and the back press roller.
Figure 9:
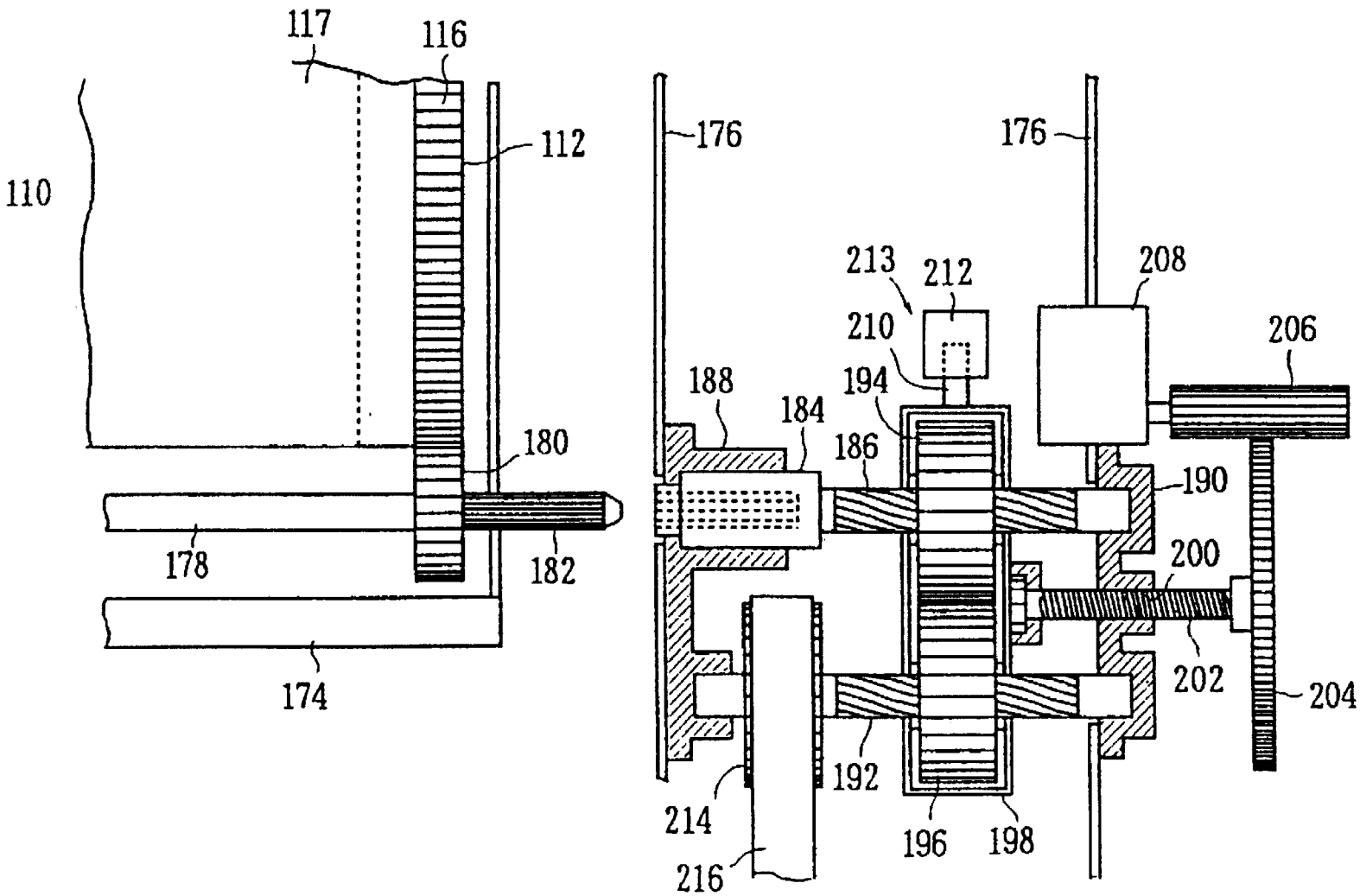
FIG. 9 is a diagrammtical view of a stencil printer incorporating another mechanism for variably adjusting the relative rotational position between the printing drum and the back press roller.

FIGS. 8 and 9 are a reproduction of FIGS. 1 and 2 of said Japanese Patent Application 5-306033, wherein, however, reference numerals are all increased by "100" from those in the original FIGS. 1 and 2 to discriminate the constructions herein referred to as a prior art from the constructions of the embodiment of the present application. The construction of FIG. 8 includes a printing drum 110 corresponding to the printing drum 10 in the present application.

In more detail, the printing drum has a pair of disk members 112 forming opposite axial end portions of the printing drum which are connected with one another by a transverse bar member 114 extending therebetween in parallel with a generation of the cylindrical surface of the printing drum. A perforated sheet 117 having a rectangular shape in development is mounted with opposite side edge portions thereof being freely seated around the pair of disk members 112. The pair of disk members 112 are each formed with a gear wheel 16 along a side periphery thereof. An inking roller 118 is provided at the inside of the cylindrical body formed by the perforated sheet 117. The inking roller 118 is adapted to be biased against the cylindrical perforated sheet from the inside thereof at a circumferential region thereof excluding a part thereof lapping over the transverse bar member 114 so that each portion of the perforated sheet biased by the inking roller 18 is temporarily bulged out downward in the figure toward a back press roller 120, to close a nipping region 122 left between opposing portions of the printing drum and the back press roller. The back press roller 120 is of the same diameter as the printing drum 110, and the printing drum and the back press roller are driven in synchronization with one another at a common rotational speed in opposite rotational directions. In order to avoid that the transverse bar member 114 of the printing drum bumps against a part of the back press roller 120, the latter is formed with a transverse groove 124 extending in parallel with a generatrix thereof at a circumferential position corresponding to the transverse bar member 114. The transverse groove 124 is designed to have a band width large enough to allow a relative rotational shifting between the printing drum 110 and the back press roller 120 carried out in a manner described hereinbelow. 125 is a clamp for temporarily fastening the leading end of a print sheet to the back press roller 120.

126 is a rotary power source for rotationally driving the printing drum 110 and the back press roller 120. The rotary power source has an output pulley 128 which is drivingly connected with a pulley 132 by an endless belt 130. The pulley 132 is coaxially connected with another pulley 134 of the same diameter and a pair of gear wheels 136 which are in meshing engagement with a pair of gear wheels 116 each provided at each of the pair of disk members 112. The back press roller 120 is coaxially connected with a pulley 138 which is drivingly connected with the pulley 132 by an endless belt 156 which turns around a series of guide pulleys 140, 142, 144, 146, 148, 150, 152 and 154. Thus, the rotation of the output pulley 128 turns the printing drum 110 in a rotational direction opposite thereto via the endless belt 130, pulley 132, gear wheels 136 and gear wheels 116 so that the printing drum is rotated in anti-clockwise direction in the figure, while the back press roller 120 is synchronously driven in the rotational direction opposite to that of the printing-drum 110.

The guide pulleys 140, 144, 146, 148, 152 and 154 are rotationally supported by a frame body not shown in the figure each to rotate about a fixed central axis. In contrast, the pulleys 142 and 150 are rotationally supported by a pulley support member 158 which is supported by the frame body of the printer by guide means not shown in the figure to be movable leftward/rightward in the figure. The pulley support member 158 is formed with a threaded bore 160 to extend in the direction of movement thereof, into which a part of the threaded rod 161 is screwed. The threaded rod 161 is rotationally supported from the frame body of the printer via bearing means 162 and 163 so as to be rotatable at a fixed axial position. A gear wheel 164 is mounted at an end of the threaded rod 161 to be in meshing engagement with a gear wheel 166 which is rotationally driven by a pulse motor 168 mounted to the frame body of the printer. The pulley support member 158 has a finger projection 170 adapted to cooperate with an optical sensor 172 which detects a shift position of the pulley support member 158 when it moves rightward from the position shown in the figure such that the center of the finger projection 170 aligns with the center of the optical sensor 72, thus the finger projection 170 and the optical sensor 172 providing a standard position detection means 173 of the relative rotational position between the printing drum and the back press roller.

In the construction shown in FIG. 8, when the gear wheel 164 is rotated by the pulse motor 168 in clockwise direction as viewed from the right side of the figure, the pulley support member 158 is shifted rightward in the figure by the screw engagement of the threaded rod 161 and the threaded bore 160. When the pulley support member 158 is shifted rightward in the figure, the pulleys 142 and 150 supported thereby are simultaneously shifted rightward by a common amount. By such a simultaneous shifting of the pulleys 142 and 150 rightward in the figure, the length of extension of a part of the endless belt 156 extending from the pulley 136 to the pulley 138 through the guide pulleys 140, 142, 144 and 146 increases twice as much as the amount of shifting of the pulley 142, while the length of extension of a part of the endless belt 156 extending from the pulley 136 to the pulley 138 through the guide pulleys 154, 152, 150 and 148 decreases twice as much as the amount of shifting of the pulley 150, with no increase or decrease of the tension of the endless belt 156.

However, as a result of the relative change between the length of extension between the pulleys 134 and 138 in the opposite portions of extension, the relative rotational angle between the printing drum 110 and the back press roller 120 changes accordingly. Therefore, when a printing sheet is carried by the back press roller 120 with its leading edge being fastened by the clamp 125, the relative longitudinal position of the print image to the print sheet is variably adjusted by shifting the pulley support member 158 rightward or leftward in the figure by a corresponding operation of the pulse motor 168 in either rotational direction.

FIG. 9 is a schematic view of another embodiment of the stencil printer according to Japanese Patent Application 5-306033, showing the phase difference adjustment means forming an essential portion of the invention. In FIG. 9 the printing drum 110 is partially shown in a plan view, together with one of a pair of disk 112, one of a pair of gear wheels 116 and a part of perforated sheet 117. In FIG. 9, the printing drum 110 is rotatably supported by the frame part 174 which is a carrier mounted to be movably relative to the frame part 176 by rail means not shown in the figure. A more detailed constructions of such a printing drum movably carrying device is shown in copending U.S. patent application No. 08/332,069, the disclosure of which is hereby incorporated by reference, assigned to the same assignee as the present application. A pair of gear wheels 180 are meshed with the pair of gear wheels 116, respectively, the gear wheels 180 being supported by a shaft 178 which is rotatably supported by the carrier 174 via bearing means not shown in the figure. A spline shaft 182 is coaxially provided at one end of the shaft 178 and is adapted to engage into a correspondingly splined socket 184 rotatably received. The gear wheels 180 correspond to the gear wheels 136 of the embodiment of FIG. 8.

The rotatable socket 184 is constructed as integral with a spline shaft 186 formed with helical splines. The other end of the spline shaft 186 is rotatably received in a bearing block 190 mounted to the frame body 176. Between the bearing blocks 188 and 190 there is rotatably mounted another spline shaft 192 also formed with helical splines. Around the spline shaft 186 and 192 there are mounted a pair of mutually meshing gear wheels 194 and 196 each having a central spline bore formed with helical grooves adapted to mesh with the helical splines of the spline shafts 186 and 192, respectively. The gear wheels 194 and 196 are housed in a gear box 198. The bearing block 190 is formed with a threaded bore 200 in which a screw rod 202 is engaged so that one end thereof is connected with the gear box 198 to allow free rotation of the screw rod 202 relative to the gear box 198 but mutually fixed in axial directions. At the other end of the screw rod 202 there is mounted a gear wheel 204 with which a pinion 206 is engaged. The pinion 206 is supported and driven by a pulse motor 208. The gear box 198 has a finger projection 210 which cooperates with an optical sensor 112 such that a standard axial position of the gear box 198 in the frame body 176 is detected when the center of the finger projection 110 aligns with the center of the optical sensor 112. Therefore, the finger projection 110 and the optical sensor 112 provide in combination a standard position detection means 113 of the gear box 198.

A pulley 214 is mounted on the spline shaft 192 to rotate therewith, and around the pulley 214 there is engaged an endless belt 216 adapted to be driven by a rotational power source which also drives the back press roller, driving the printing drum 210 via spline shaft 192, gear wheels 196 and 194, and spline shaft 186.

In the above-mentioned construction, when the pulse motor 208 is energized to drive the pinion 206 so that the gear wheel 204 is rotated anti-clockwise as viewed from the right side of figure, the gear box 198 moves rightward in the figure, and therefore, assuming that the belt 216 is now not driven, the gear wheel 196 rotates anti-clockwise while the gear wheel 194 rotates clockwise, both viewed from the right side in the figure, so that the spline shaft 186 rotates clockwise as much as the rotational angle of the gear wheel 194 plus a rotational angle corresponding to a rotation caused in the spline shaft 186 by the axial shifting of the gear wheel 194 relative to the spline shaft 186, due to the helical inclination of the spline. Thus, the relative rotational angle of the printing drum 110 is shifted relative to the rotational angle of the back press roller. Such a relative rotational angle between the printing drum and the back press roller is variably adjusted in either direction according to a corresponding actuation of the pulse motor 208 in either rotational direction. Although the shafts 186 and 192 are both formed as a helically splined shaft in the shown embodiment, the spline of one of these two shafts may be straight.

Now the description is continued with reference again to FIG. 1. When such a print image longitudinal position adjustment mechanism is incorporated in the printer, the point 28 on the back press roller 14 corresponding to the bordering point 26 between the leading end portion **20*a* and the perforated portion of the flexible perforated sheet 20 and the point 34 on the back press roller 14 corresponding to the bordering point 32 between the trailing end portion 20*b* and the perforated portion of the flexible perforated sheet 20 move in biasing ranges 38 and 40, respectively. Therefore, when the magnitude of the outer circumferential portions 30 and 36 are determined by taking the biasing ranges 38 and 40 corresponding to the change of the relative rotation phase between the printing drum 10 and the back press roller 14 according to the incorporation of such a print image longitudinal position adjustment means into consideration as in the shown embodiment, the rigid squeezing back by the back press roller 14 is applied to the bordering point 26 or 32 when it passes through a position contacting the inking roller 12, regardless of the changes of the relative rotation phase between the printing drum and the back press roller 14 effected by the print image longitudinal position adjustment, thereby always definitely preventing ink from leaking out beyond the bordering point 26 or 32 onto the non-perforated leading end portion 20*a* or trailing end portion 20*b***.

FIG. 2 is a diagrammatical view showing an embodiment that the present invention is incorporated into a printer for a multiplied printing proposed by Japanese Patent Application 2-223550 (Laid-open Publication 4-105984) by the same assignee as that of the present application, wherein three printing drums each having the same construction as that shown in FIG. 1 is combined with one back press roller having the same construction as that shown in FIG. 1, so as to carry out a three layered stencil printing almost at the same time. When the circumferential lengths P and G of the perforated portion and the transverse groove of each of these printing drums and the common back press roller and the relative rotation phase therebetween are determined in the same manner as described with reference to FIG. 1, it is effectively prevented that ink leaks out beyond the border between the perforated portion and the non-perforated portion over the non-perforated portion in each printing drum.

In FIG. 2, the portions corresponding to those shown in FIG. 1 are designated by the same reference numerals as in FIG. 1, and since the corresponding portions make substantially the same functions, a duplicative description with respect to the embodiment shown in FIG. 2 will be omitted.

Figure 3:
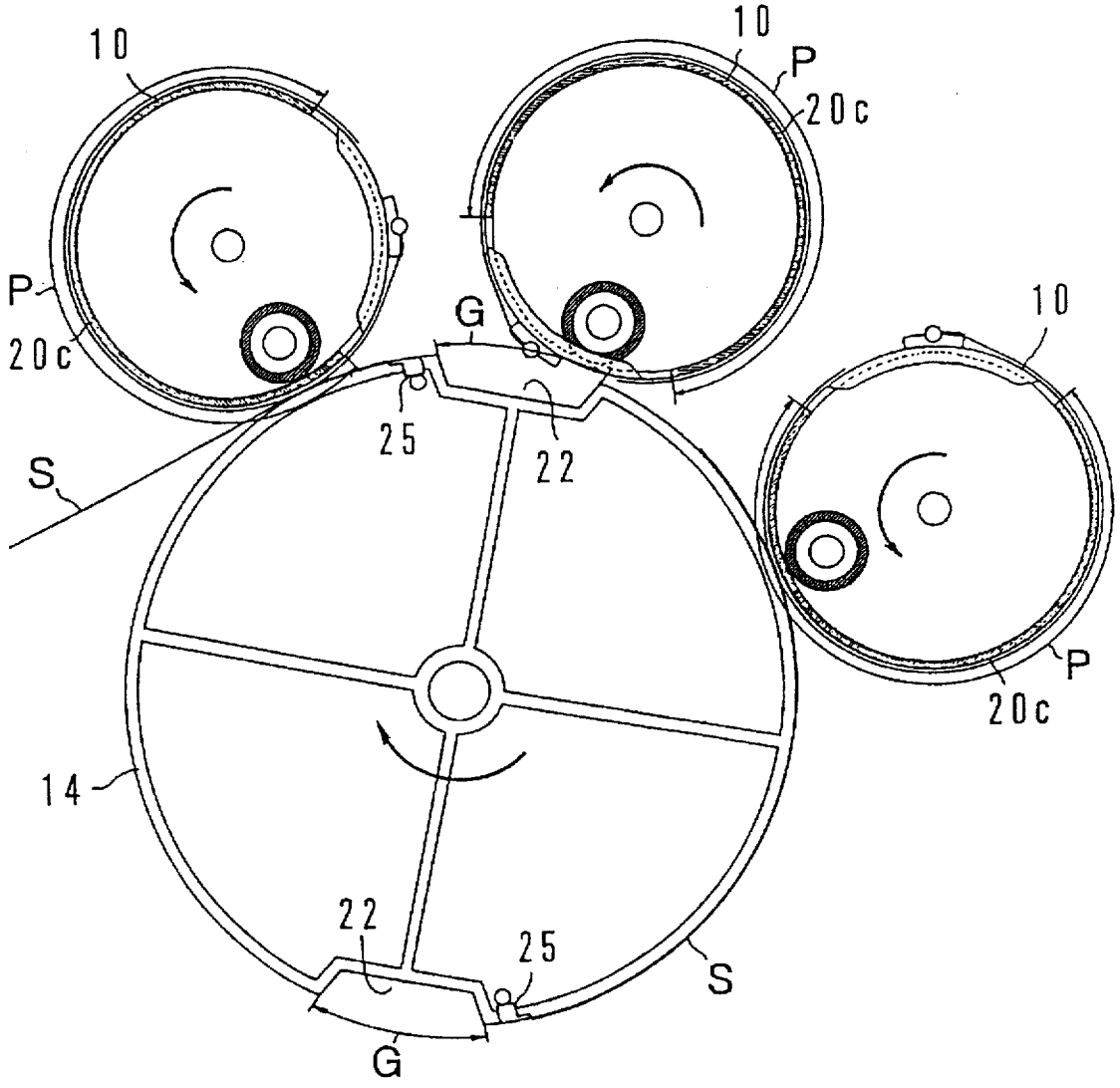
FIG. 3 is a diagrammatical view showing still another embodiment of a multiple stencil printer in which the present invention is incorporated.

Although the multiple stencil printer shown in FIG. 2 is constructed such that three printing drums cooperate with a common back press roller having the same diameter as the printing drums, a similar type of multiple stencil printer may be constructed such that three printing drums cooperate with a common back press roller having an integer times diameter of the printing drum such as two times, three times and so on. In such an embodiment, when the above-mentioned condition is satisfied with respect to the outer circumferential length of the perforated portion of each of the drums and outer circumferential length of the transverse groove of the back press roller, the leaking out of the ink from the perforated portion and the non-perforated portion in each drum is effectively prevented. FIG. 3 is a diagrammatical view similar to FIG. 2, showing an embodiment in which the back press roller has a diameter which is two times of the diameter of each printing drum. In the embodiment shown in FIG. 3, the back press roller has two transverse grooves at diametrically opposite portions and two clamps so that two sheets of printing are available by each one rotation of the back press roller. In this embodiment the outer circumferential length between the two transverse grooves of the back press roller 14 is longer than that of the perforated portion of each printing drum 10.

Figure 4:
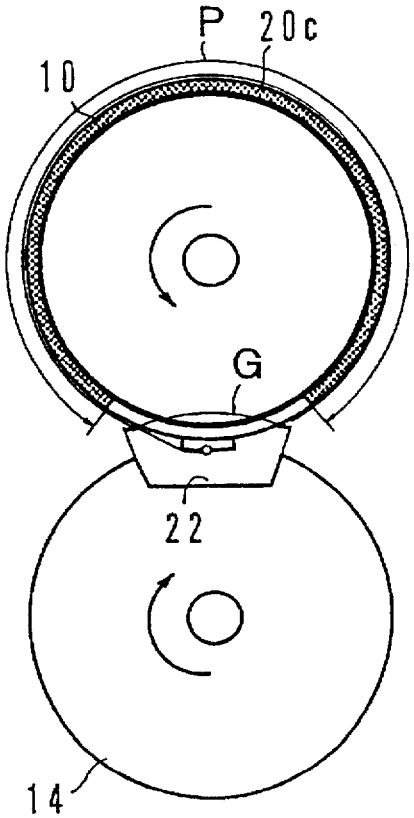
FIG. 4 is a diagrammatical view showing an embodiment of an ink pad type stencil printer in which the present invention is incorporated.

FIG. 4 is a diagrammatical view showing an embodiment that the present invention is incorporated in a stencil printer having such a construction that the perforated portion of the printing drum is constructed by an ink pad impregnated with ink such that the ink is oozed out from the perforated portion when the perforated portion is pressed by the back press roller via a print sheet and a stencil sheet from the outer circumferential surface thereof when the printing is carried out. In this type of stencil printer, it is also effectively prevented that ink leaks out from the perforated portion over the non-perforated portion beyond the border between the perforated portion and the non-perforated portion of the printing drum when the outer circumferential lengths P and G of the perforated portion of the printing drum 10 and the transverse groove of the back press roller 4 and the relative rotation phase therebetween are so determined as described with reference to FIG. 1.

In FIG. 4, the portions corresponding to those shown in FIG. 1 are designated by the same reference numerals, and since the corresponding portions make substantially the corresponding functions, a duplicative description with respect to the embodiment shown in FIG. 4 may be omitted.

Figure 5:
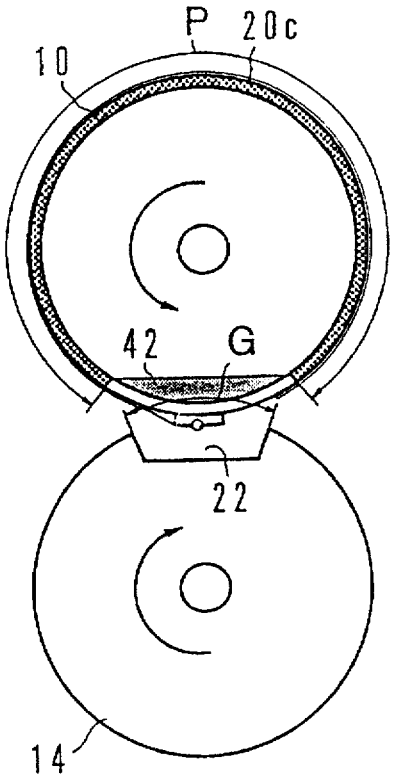
FIG. 5 is a diagrammatical view showing still another embodiment of the present invention.

FIG. 5 is a diagrammatical view showing an embodiment that the present invention is incorporated into a stencil printer in which the printing drum is directly supplied with ink such that the ink forms a deposit layer 42 when the printing drum is at rest. In FIG. 4, the portions corresponding to those shown in FIG. 1 are designated by the same reference numerals, and the corresponding portions make substantially the corresponding functions.

Figure 6:
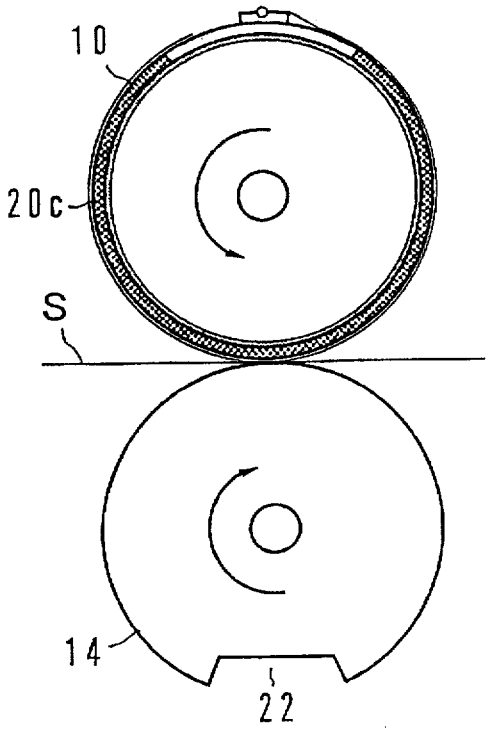
FIG. 6 is a diagrammatical view showing the stencil printer shown in FIG. 4 in an operating condition thereof.

FIG. 6 is a diagrammatical view similar to FIG. 5 showing the stencil printer shown in FIG. 5 in an operative condition that the printing drum 10 and the back press roller 14 are rotating in mutually opposite rotational directions in synchronization. As is shown in FIG. 6, the ink supplied to the inside of the printing drum is uniformly distributed over the entire inside circumferential surface of the printing drum under the action of a centrifugal force during the rotation of the printing drum so that the ink is urged out to the outside circumferential surface of the printing drum through the perforated portion 20c thereof under the pressure due to the centrifugal force acting to such an annular layer of ink. In the stencil primer in which the ink is supplied through the perforated portion of the printing drum under the action of a centrifugal force, it is also effectively prevented that the ink leaks out from the perforated portion over the non-perforated portion beyond the border therebetween of the printing drum by the outer circumferential lengths P and G with respect to the perforated portion of the printing drum and the transverse groove of the back press roller and the relative rotation phase therebetween are so determined as described with reference to FIG. 1.

Figure 7:
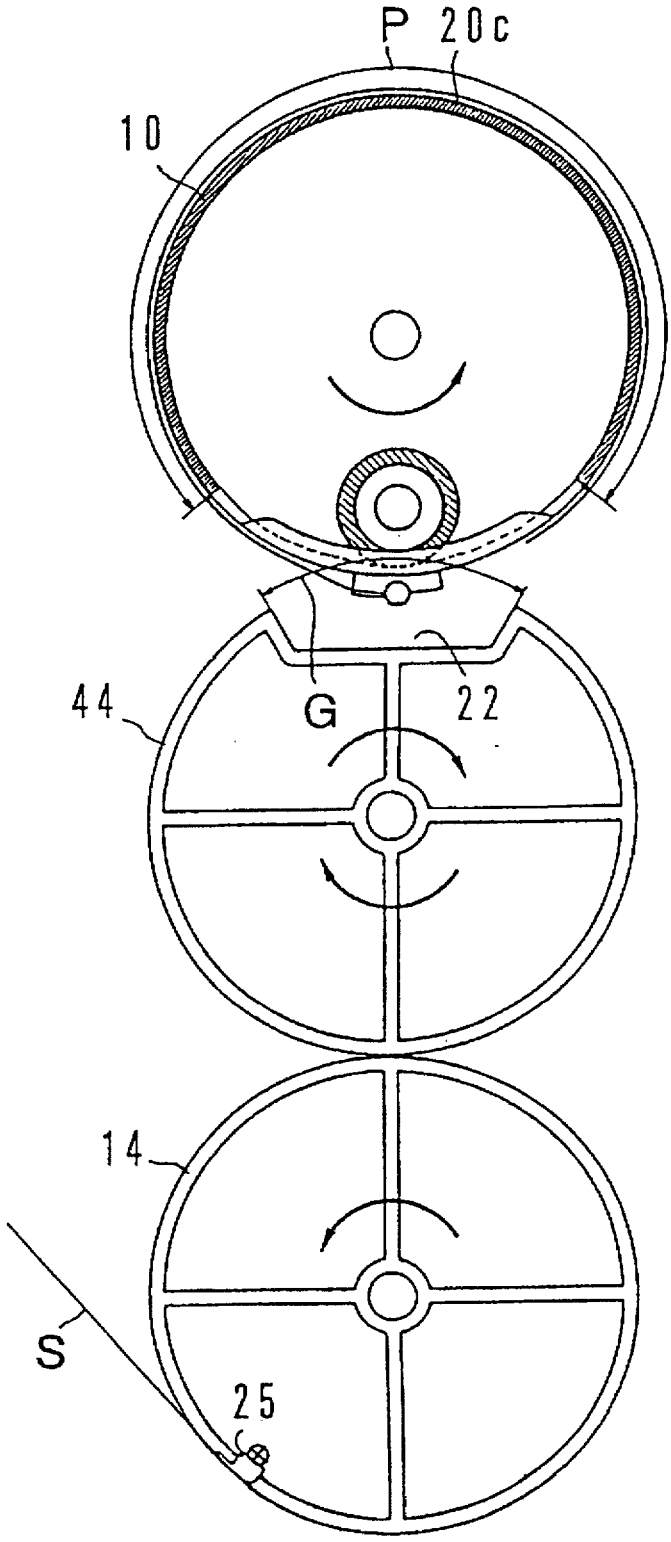
FIG. 7 is a diagrammatical view showing an embodiment of a stencil printer having a transfer roller in which the present invention is incorporated.

FIG. 7 is a similar diagrammatical view showing an embodiment that the present invention is incorporated into a stencil printer having such a construction that the stencil ink image by the printing drum 10 is formed on a transfer roller 44, and the ink image on a transfer roller is transferred onto a print sheet S fed between the transfer roller and the back press roller 14. In such a construction that the mating roller which opposes the printing drum to rotate in mutually opposite rotational direction in synchronization with the printing drum is a transfer roller which is formed with a transverse groove adapted to align with the stencil sheet leading end mounting portion of the printing drum, it is also effectively prevented that ink leaks out from the perforated portion over the non-perforated portion beyond the border therebetween in the printing drum by the outer circumferential lengths P and G with respect to the perforated portion of the printing drum and the transverse groove of the transfer roller 44 being so determined as described with reference to FIG. 1, so that the stencil printer can operate for a long period with no trouble of ink leakage.

FIG. 7, the portions corresponding to those shown in FIG. 1 are designated by the same reference numerals, and since the corresponding portions make substantially the same functions, a duplicative description will be omitted. In this connection, however, the back press roller 14 in the printing drum-transfer roller-back press roller construction shown in FIG. 7 need not necessarily be of the same diameter as the transfer roller or the printing drum, but may have a diameter substantially smaller than the transfer roller or the printing drum.

In the embodiments shown in FIGS. 1, 2, 3 and 7 in which the perforated portion of the cylindrical circumferential wall of the printing drum is bulged out radially outwardly as much as a small amount by the inking roller, the printing drum and the back press roller are arranged to rotate about each fixed central axis such that a clearance of several millimeters is left between the outer circumferential surface of the perforated portion of the cylindrical circumferential wall of the printing drum and the outer circumferential surface of the back press roller or the transfer roller when the perforated portion of the printing drum is not urged radially outwardly by the inking roller, and only when the printing is carried out, the stencil sheet wrapped around the printing drum is pressed against a print sheet supported by the back press roller from the rear side thereof or the outer circumferential surface of the transfer roller at the portion thereof bulged out with the perforated portion of the printing drum by the inking roller. However, the present invention is also applicable to a stencil printer in which the printing drum and the back press roller are pressed against one another by a parallel shifting of one or both of the shifts supporting the printing drum and the back press roller.

Although the printing drum is a cylindrical body in the embodiments described above, the printing drum may be of the two drum type construction which itself is known as having two rolls arranged in parallel and an endless belt expanded therearound, the endless belt having a perforated construction except a stencil sheet mounting portion.

Although the invention has described with respect to several embodiments thereof in the above, it will be apparent for those skilled in the art that various modifications are possible with respect to the shown embodiments within the scope of the present invention.

We claim:

1. A stencil printer comprising;

a printing drum having two axially opposite annular edge portions, a circumferential wall portion extending between said two annular edge portions to define a cylindrical configuration and including a perforated portion and a strip-like stencil sheet leading end mounting portion extending between said two annular edge portions along a generatrix of said cylindrical configuration, a back press roller having a transverse groove at an outer circumferential portion extending along a generation thereof, said printing drum and said back press roller being rotatably supported and arranged to be close to and in parallel with one another for rotating in mutually opposite rotational directions in synchronization with one another such that said stencil sheet leading end mounting portion is aligned with said transverse groove when the stencil printer is operated with a stencil sheet wrapped around said printing drum and a print sheet fed between said printing drum and said back press roller so as to apply a stencil print to said print sheet with ink supplied through said perforated portion of said printing drum from the inside thereof and said stencil sheet, means for selectively shifting said printing drum and said back press roller from a standard relative position to a second relative position in a first direction and to a third relative position in a second direction opposite to said first direction, wherein a first midpoint of an arc defined by said stencil sheet leading end mounting portion of said printing drum and a second midpoint of an arc defined as a circumferential length of said transverse groove of said back press roller are just aligned with one another in said standard relative position, said first and second midpoints being selectively misalignable over a circumferential length of a biasing range, said biasing range corresponding to a chance in a relative rotational phase between said printing drum and said back press roller for the shifting from said standard relative position to said second and third relative position adjusting the position of the stencil print relative to the print sheet, wherein the back press roller is selected from the group consisting of:

(a) a back press roller having a same diameter as a diameter of said printing drum, the total length of the circumferential length of said perforated portion of said printing drum and the circumferential length of the biasing range being smaller than the circumferential length of a part of said back press roller excluding said transverse groove and (b) a back press roller having a diameter which is two or higher integer times of the diameter of said printing drum, said back press roller having said integer number of said transverse grooves, the total of the outer circumferential length of said perforated portion of said printing drum plus the circumferential length of the biasing range being smaller than the outer circumferential length between two adjacent ones of said transverse grooves of said grooves of said back press roller, whereby said perforated portion is not exposed to said transverse groove in spite of said relative rotational shifting between said printing drum and said back press roller within said biasing range for adjusting the position of the stencil print relative to the print sheet.

2. A stencil printer according to claim 1, wherein said printing drum and said back press roller have the same diameter as one another, and the total of the circumferential length of said perforated portion of said printing drum plus the circumferential length of the biasing range is smaller than the circumferential length of the part of said back press roller excluding said transverse groove.

3. A stencil printer according to claim 1, wherein the diameter of said back press roller is two or higher integer times of the diameter of said printing drum, while said back press roller has said integer number of said transverse grooves, the total of the outer circumferential length of said perforated portion of said printing drum plus the circumferential length of the biasing range being smaller than the outer circumferential length between two adjacent ones of said transverse grooves of said back press roller.

4. A stencil printer according to claim 1, comprising an inking roller for effecting a squeezing action by contacting an inside surface of said printing drum to supply at least a portion of the ink through said perforated portion of said printing drum.

5. A stencil printer according to claim 1, comprising means for applying compression to said perforated portion of said printing drum to supply at least a portion of the ink through said perforated portion of said printing drum by oozing out of ink from said perforated portion due to a compression applied thereto by said means for applying compression.

6. A stencil printer according to claim 1, wherein said printing drum is sufficiently rotatable for supplying at least a portion of the ink through said perforated portion of said printing drum by a centrifugal force acting to the ink due to rotation of said printing drum.

7. A stencil printer comprising:

a printing drum having two axially opposite, annular edge portions, a circumferential wall portion extending between said two annular edge portions to define a cylindrical configuration and including a perforated portion and a strip-like stencil sheet leading end mounting portion extending between said two annular edge portions along a generatrix of said cylindrical configuration, a transfer roller having a transverse groove at a circumferential portion thereof along a generation thereof, a back press roller, said printing drum and said transfer roller being rotatably supported and arranged to be close to and in parallel with one another such that said stencil sheet leading end mounting portion is aligned with said transverse groove and for rotating in mutually opposite rotational directions in synchronization with one another, said transfer roller and said back press roller are rotatably supported and arranged to be close to and in parallel with one another for rotating in mutually opposite rotational directions in synchronization with one another when the stencil printer is operated with a stencil sheet wrapped around said printing drum and a print sheet fed between said transfer roller and said back press roller for applying an ink image onto said transfer roller with ink supplied through said perforated portion of said printing drum from the inside thereof and said stencil sheet, while said ink image on said transfer roller is transferred onto said print sheet fed between said transfer roller and said back press roller, means for selectively shifting said printing drum and said transfer roller from a standard relative position to a second relative position in a first direction and to a third relative position in a second direction opposite to said first direction, wherein a first midpoint of an arc defined by said stencil sheet leading end mounting portion of said printing drum and a second midpoint of an arc defined as a circumferential length of said transverse groove of said transfer roller are just aligned with one another in said standard relative position, said first and second midpoints being selectively misalignable over a circumferential length of a biasing range, said biasing range corresponding to a change in a relative rotational phase between said printing drum and said back press roller for the shifting from said standard relative position to said second and third relative positions, thereby adjusting the position of the stencil print relative to the print sheet, wherein the back press roller is selected from the group consisting of:

(a) a back press roller having a same diameter as a diameter of said printing drum, the total length of the circumferential length of said perforated portion of said printing drum and the circumferential length of the biasing range being smaller than the circumferential length of a part of said back press roller excluding said transverse groove, and (b) a back press roller having a diameter which is two or higher integer times of the diameter of said printing drum, said back press roller having said integer number of said transverse grooves, the total of the outer circumferential length of said perforated portion of said printing drum plus the circumferential length of the biasing range being smaller than the outer circumferential length between two adjacent ones of said transverse grooves of said grooves of said back press roller, whereby said perforated portion is not exposed to said transverse groove in spite of said relative rotational shifting between said printing drum and said transfer roller within said biasing range for adjusting the position of the stencil print relative to the print sheet.

8. A stencil printer according to claim 7, wherein said printing drum and said transverse roller the same diameter as one another, and the total of the circumferential length of said perorated portion of said printing drum plus the circumferential length of the biasing range is smaller than the circumferential length of the part of said transverse roller excluding said transverse groove.

9. A stencil printer according to claim 7, comprising an inking roller for erecting a squeezing action by contacting an inside surface of said printing drum to supply at least a portion of the ink through said perforated portion of said printing drum.

10. A stencil printer according to claim 7, comprising means for applying compression to said perforated portion of said printing drum to supply at least a portion of the ink through said perforated portion of said printing drum by oozing out of ink from said perforated portion due to a compression applied thereto by said means for applying compression.

* * * * *